US008272083B1

(12) United States Patent
Liston et al.

(10) Patent No.: US 8,272,083 B1
(45) Date of Patent: Sep. 25, 2012

(54) SYSTEM AND METHOD FOR FAUCET INSTALLATIONS

(76) Inventors: Thomas D. Liston, Denver, CO (US); Zachary E. Conrad, Denver, CO (US)

( * ) Notice: Subject to any disclaimer, the term of this patent is extended or adjusted under 35 U.S.C. 154(b) by 0 days.

(21) Appl. No.: 13/066,635

(22) Filed: Apr. 20, 2011

(51) Int. Cl.
*E03C 1/00* (2006.01)

(52) U.S. Cl. ..... 4/695; 137/606; 411/432; 411/433; 411/427

(58) Field of Classification Search ..... 137/359, 137/606; 4/695; 411/432, 433, 427
See application file for complete search history.

(56) References Cited

U.S. PATENT DOCUMENTS

| | | | | | |
|---|---|---|---|---|---|
| 463,301 | A | | 11/1891 | Brandner | |
| 663,208 | A | | 12/1900 | Wrensch | |
| 1,021,110 | A | * | 3/1912 | Niewohner | 411/244 |
| 1,082,993 | A | * | 12/1913 | Beattie | 411/433 |
| 1,915,588 | A | * | 6/1933 | Arrington | 411/433 |
| 3,815,434 | A | * | 6/1974 | Seger | 74/424.79 |
| 4,023,431 | A | | 5/1977 | Pavlas | |
| 4,132,146 | A | * | 1/1979 | Uhlig | 411/433 |
| 4,226,164 | A | * | 10/1980 | Carter | 411/433 |
| 4,281,857 | A | * | 8/1981 | Randall | 285/34 |
| 4,502,165 | A | * | 3/1985 | Szemeredi et al. | 4/695 |
| 4,828,444 | A | * | 5/1989 | Oshida | 411/437 |
| 5,000,640 | A | * | 3/1991 | Haas, Jr. | 411/432 |
| 5,039,266 | A | * | 8/1991 | Nagayoshi et al. | 411/433 |
| 5,098,242 | A | * | 3/1992 | Schaty | 411/437 |
| 5,946,746 | A | | 9/1999 | Bloom | |
| 6,821,070 | B1 | | 11/2004 | Thompson | |
| 6,953,314 | B2 | * | 10/2005 | Magagna | 411/433 |
| 7,162,755 | B2 | * | 1/2007 | Mintz et al. | 4/695 |
| 7,284,731 | B1 | * | 10/2007 | Johnson et al. | 248/74.4 |
| 7,353,840 | B1 | | 4/2008 | Deinken et al. | |
| 2006/0039776 | A1 | * | 2/2006 | Schutz | 411/432 |
| 2006/0101576 | A1 | * | 5/2006 | Rhodes | 4/695 |
| 2007/0044232 | A1 | * | 3/2007 | McNerney et al. | 4/695 |
| 2007/0207010 | A1 | * | 9/2007 | Caspi | 411/432 |
| 2008/0014049 | A1 | * | 1/2008 | Dvorak | 411/433 |

OTHER PUBLICATIONS

Price Pfister Ideas in Phaucets, 36 Series, Copyright 2007, Price Pfister, Inc.

* cited by examiner

*Primary Examiner* — John Rivell
*Assistant Examiner* — Minh Le
(74) *Attorney, Agent, or Firm* — Ramon L. Pizarro; Edwin H. Crabtree

(57) ABSTRACT

A faucet installation system and method for use on faucets that include a valve stem that is adapted for insertion through an aperture in a sink or a countertop is disclosed. The system uses a valve having a valve stem that is adapted for connection to a water supply line that connects to a water supply valve. The valve stem includes an external surface that cooperates with a retention nut that is split, so that retention nut may be attached to the valve stem after the valve stem and water supply line have been attached to one another and inserted through the aperture in the sink or countertop, eliminating the need to attach the water supply line to the stem from under the sink or countertop.

6 Claims, 3 Drawing Sheets

SYSTEM AND METHOD FOR FAUCET INSTALLATIONS

BACKGROUND OF THE INVENTION (a) Field of the Invention

This application relates to a system and method for installing and fastening faucets onto surfaces. More particularly, but not by way of limitation, to a system and method that uses a split-nut for engaging the valve stems and tightening the valve stems against the surface that supports the faucet.

(b) Discussion of Known Art

Common faucet systems used in household applications include a hot water valve assembly and a cold water valve assembly. An example of this type of faucet systems is disclosed in U.S. Pat. No. 5,946,746, incorporated herein in its entirety by reference. These types of faucet systems include a pair of valves, each with a valve body that includes a threaded valve stem, to which a water supply line is attached. The threaded valve stem is also used to accept wing nuts that are used to retain the valve body against the sink or the counter top to which the sink or faucet system is mounted.

The problem associated with faucet systems that use a pair of faucet bodies, each with its own valve assembly, is that they first require insertion of the threaded valve stem into the sink or counter top holes, then require the mounting of the wing nuts, and then the installation of the water supply line to the end of the valve stem. While this process is simple to describe, the actual installation requires that the person performing the installation crawl under the sink or counter, reach behind the sink and first align the valve stem with the wing nut before threading the wing nut, and then align the valve stem with the nut or threaded connector of the water supply lines, and then thread the supply line onto the end of the valve stem. This process is rather tedious, and often very frustrating due to the fact that the installer must often lie on his back while installing these components. The installer's position makes it difficult to properly align the components often results in damage to the threaded sections, further complicating the proper installation. To make matters worse, the valve stem is often made of metal, and the nut or threaded connector of the supply line is often made of a plastic, which again increases the possibility of thread damage during attempts at installing the faucet.

Split-nut unions are well known in the pluming trades. The Waterway Plastics Company of 2200 East Sturgis Road, Oxnard, Calif. 93030 sells an example of a well-known split-nut union as item number 400-5491 "Heater Union Nut". A common use of the split-nut coupler is to connect a section of flared tubing to the threaded end of a pipe, and obviates the need to thread the coupling nut through the entire length of the flared tubing when joining the flared section the threaded end of the pipe. However, the use of these fittings is typically limited to low-pressure installations of a supply or drainage line to the end of a fitting.

Therefore, a review of known devices reveals that there remains a need for a device and method that facilitates the installation of faucet valve systems, and particularly there remains a need for a system that reduces or obviates the need to align the wing nut or the water supply line connector with the valve stem after the valve stem has been inserted through the installation apertures in the sink or counter top.

SUMMARY

It has been discovered that the problems left unanswered by known art can be solved by providing a faucet installation system for use on faucets that include a valve stem that is adapted for insertion through an aperture such as the installation hole made through a sink or a counter for the installation of the faucet, a preferred example of the system including:

A valve having a valve stem, the valve stem having an external surface having engagement recesses; and A retention nut, the retention nut including a pair of sections, each section having a concave inner surface and an outer surface, each of the inner surfaces having an engagement protrusion that has been adapted for engaging the engagement recesses in the external surface of the valve stem, the sections of the retention nut being adapted for connecting to one another, so that when the retention nut sections are connected to one another they provide support for biasing the engagement protrusion towards the external surface of the valve stem, and thus allow the engagement protrusion into the engagement recesses.

According to a highly preferred embodiment of the invention, the sections of the retaining nut are connected to one another through resilient connectors positioned at the ends of each of the sections. Thus, in a preferred embodiment, the retention nut is made up of two sections and the valve stem is generally cylindrical. In this embodiment each of the sections is adapted for extending over about 180 degrees of the perimeter of the external surface of the valve stem. This embodiment includes two types of resilient connectors, one of each type being mounted on each of the ends being joined. One type includes a female cylindrical portion mounted on one section, the female cylindrical portion cooperating with a male cylindrical portion mounted on the remaining section, so that female accepts the male portion to create a hinge at one of the ends being joined. The opposite end being joined includes a resilient tab with a barb on one of the sections. The other section includes an aperture with an edge adapted for accepting the resilient tab, so that pivoting the sections relative to one another about the hinge until the resilient tab is accepted in the aperture and the barb engages the edge adapted for accepting the resilient tab, and thus forming a closed nut that may be used to engage the recesses in the external surface of the valve stem.

To use the disclosed invention, it is contemplated that the user would first attach water supply lines to each of the valve stems, and then insert the water supply lines together with the valve stems into apertures that have been made in the surface for mounting the valve. Typically, this would include the apertures provided in a standard sink or countertop that supports the valve.

While it is contemplated that the disclosed system may be used with standard valve sets that require the attachment of a water supply line between the supply valve and the valve stems, it is also contemplated that the disclosed system will allow the fabrication of valve sets that have water supply hoses pre-connected by the manufacturer. This arrangement would eliminate, or greatly reduce, the possibility of leakage at the connection between the water supply line and the valve stem, and would provide the benefits of the simplified installation method disclosed here.

It will be understood that the disclosed valve installation method allows installation of a valve set in pre-made apertures for mounting valves, includes providing a valve set with water supply lines that have been connected to the valve stems, inserting the water supply lines through the pre-made apertures in the sink or countertop, while the supply lines remain connected to the valve stems. Then attaching a retaining nut to each of the valve stems, and tightening the retaining nuts against the lower surface of the sink or countertop to retain the valve set against the sink or countertop.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
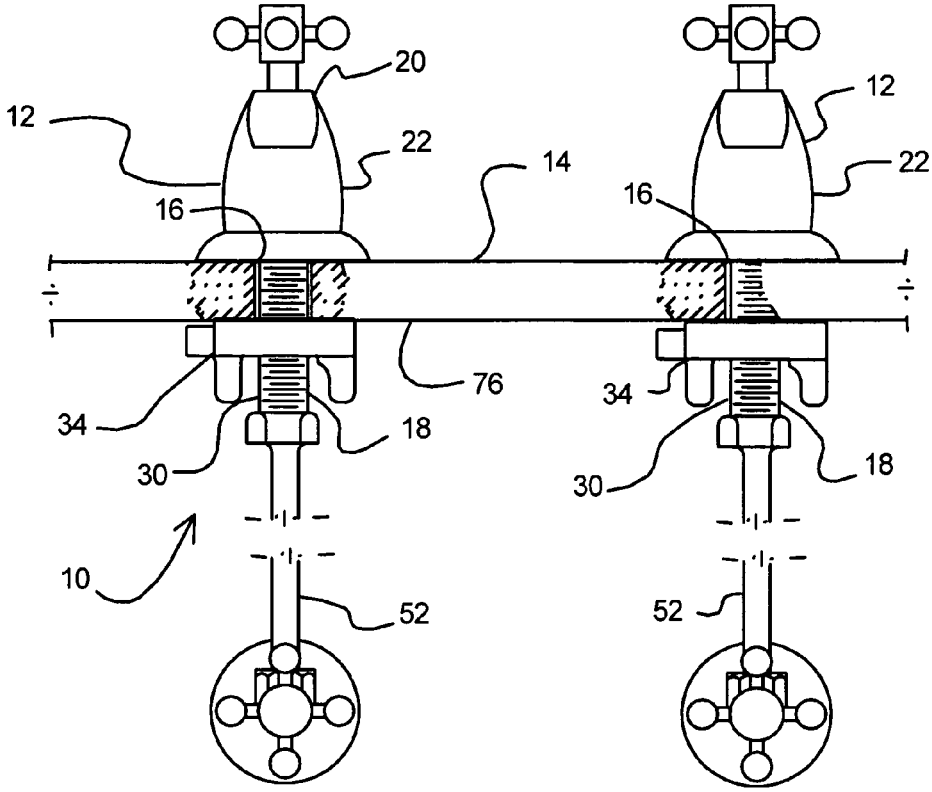
FIG. 1 illustrates a preferred embodiment of the invention as used to connect a valve set to a sink or countertop and to water supply valves.
Figure 2:
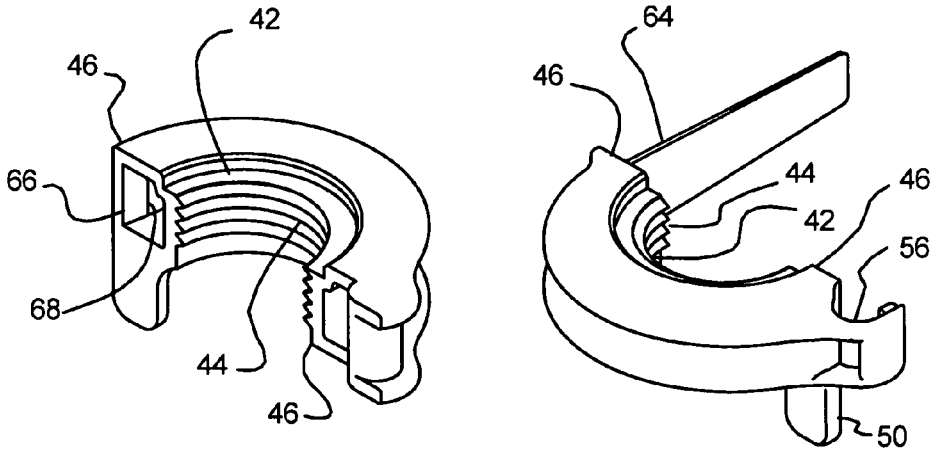
FIG. 2 is perspective view of a preferred embodiment of the sections of the retention nut used with the disclosed system.

Turning now to FIG. 1 where a faucet installation system 10 for installing a faucet valve 12 on a sink or countertop 14 has been illustrated. It will be understood from FIG. 1 that the sink or countertop will include at least one and preferably a pair of mounting apertures 16 adapted for accepting the valve stem 18 of the faucet 20 that is to be mounted. It is contemplated that the disclosed invention will be particularly useful for valve assemblies 22 that include a pair of faucet valves 12 connected to one another through a mounting plate 24. Each of the valves 12 includes a valve stem 18 that extends away from the mounting plate 24. Also illustrated is that each of the valve stems 18 is designed to fit through the apertures 16. Additionally, each of the valve stems 18 includes an external surface 26 having a perimeter 28. The perimeter of the valve stems 18 includes an engagement section 30, which in the example illustrated in FIG. 1 includes helical threads 32. As will be discussed in conjunction with FIG. 5, below, the engagement section 30 need not be helical threads, but may also be parallel protrusions or protrusions that generally parallel to one another.

Figure 3:
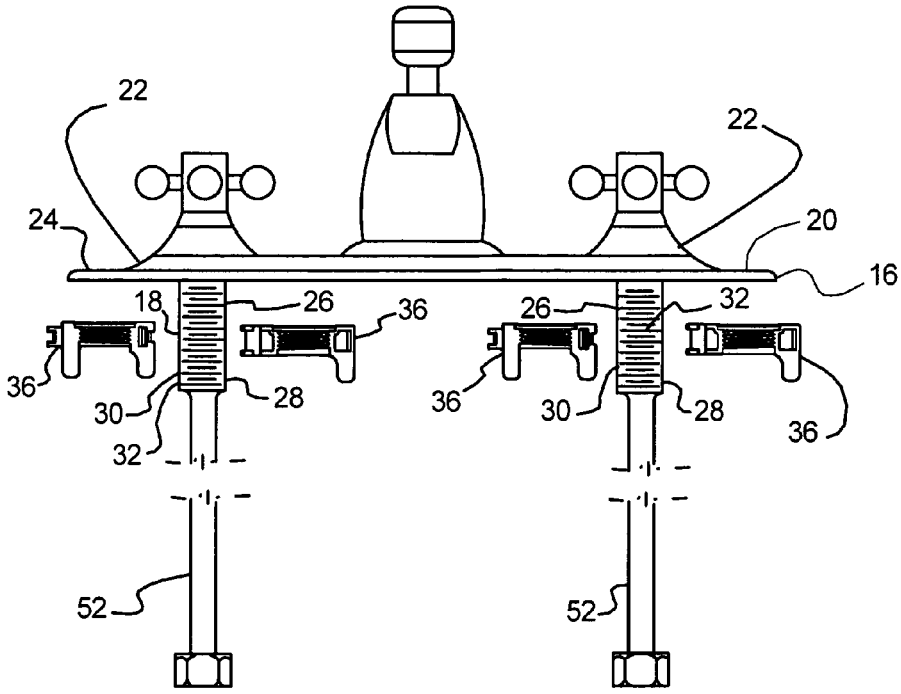
FIG. 3 illustrates the positioning of the sections of the retention nuts prior to attaching the retention nuts to the stems of the valve assemblies in an example where the valve assemblies are manufactured with the water supply lines pre-installed.

FIGS. 1 and 3 show that it is contemplated that, when using the disclosed invention with a pair of faucet valves 12, a pair of retention nuts 34 will be used to engage the valve stems 18. According to a preferred embodiment, each retention nut 34 is made up from at least two sections, and preferably a pair of sections 36. Each section 36 includes a concave inner surface 38 and an outer surface 40. The concave inner surface 38 of at least one of the sections 36 will preferably include an engagement protrusion 42 that has been adapted for engaging the engagement with the engagement section 30 of the stem 18. In the example illustrated in FIGS. 1-3 and 4A-4C, the engagement protrusions 42 are simply helical thread 44.

Figure 4A:
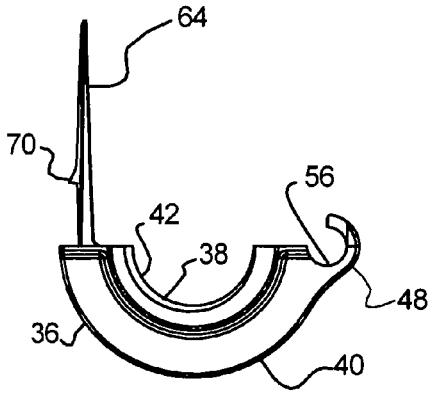
FIG. 4A is a top plan view of an example of one of the sections of the retention nuts used with the disclosed invention.
Figure 4B:
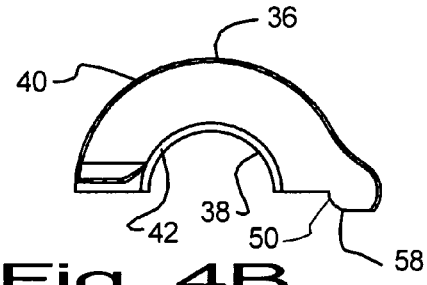
FIG. 4B is a top plan view of an example of one of the sections of the retention nuts used with the disclosed invention, the section illustrated in FIG. 4B being the mating section for the example illustrated in FIG. 4A.
Figure 4C:
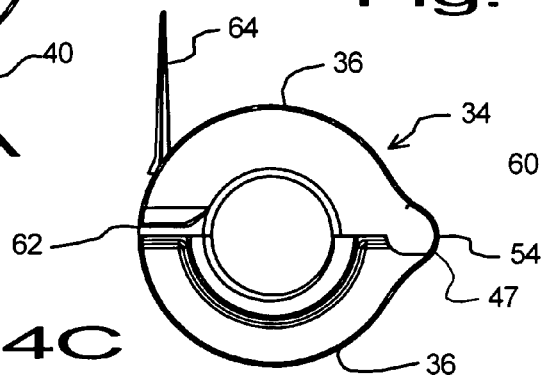
FIG. 4C illustrates the mating of the sections illustrated in FIGS. 4A and 4B.

Referring now to FIGS. 4A-4C it will be understood that in a preferred example of the disclosed invention each of the sections 36 of each retention nut 34 includes a pair of ends 46. At least one of the ends of each of the sections 36 will include a resilient connector 48 that will be used for engaging a mating connector 50 end on the mating section 36. The mating resilient connectors 48 will be positioned such that the sections 36 may be connected to one another to form the retention nut 34 in its closed position, illustrated in FIG. 4C. The retention nut 34 will extend around the valve stem 18 to allow the engagement protrusion 42 to engage the engagement recesses, or threads 32, on the external surface 26 of the valve stem 18 so that the retention nut 34 may be retained at a fixed location along the valve stem 18.

It is important to note that the disclosed invention allows the user to install the water supply lines 52 to the valve stem 18 prior to installing the valve assembly 22 through the mounting apertures 16 in the sink or countertop. This will do away with the need for the installer to do both the operation of installing the water supply lines as well as the operation of installing the retention nuts from below the sink or countertop, and thus relieving the user of trying to contort his body to reach these connections from below the sink or countertop. Thus, the disclosed invention not only does away with the need to connect the water supply lines 52 from below the sink or countertop, but also provides a retention nut 34 that can be installed along the valve stem 18, instead of from the end of the valve stem 18, and thus reducing the amount of time and effort needed to tighten the retention nut 34 and the valve assembly 22 against the sink or countertop.

As can be understood from FIGS. 1, 3, and 4C, each of the retention nut sections 36 is adapted for extending around about 180 degrees of the perimeter of each one of the valve stems 18. It is contemplated that the retention nut could be made from a resilient material and includes one threaded section that extends about 270 degrees and a closure strap that or section that would prevent the threaded section from expanding and loosing the thread engagement with the stem when the assembly is tightened.

As illustrated in FIGS. 4A-4C, in the preferred embodiment of the invention the resilient connectors 47, which includes the connector 48 on one end and the mating connector 50 on the mating section of the retention nut 34, will include a first set of resilient connectors 54 comprising a female cylindrical portion 56 mounted on one of the sections 36, and a male portion 58 mounted on another or the remaining section 36 of the retention nut 34. The male portion 58 will cooperate with the female cylindrical portion 56, so that female cylindrical portion 56 accepts the male portion 58 to create a hinge 60 between the sections 36 being joined. The hinge 60 will allow the sections 36 to pivot relative to one another, so that the retention nut can assume the closed position illustrated in FIG. 4C.

According to a preferred embodiment of the invention, illustrated in detail in FIGS. 2 and 4A-4C, the resilient a second set of resilient connectors 62, which include a resilient tab 64, preferably with an engagement protrusion or barb 70. The resilient tab 64 is adapted for engaging an aperture 66, illustrated in FIG. 2, which is incorporated into the mating section 36. Preferably, the aperture 66 includes an edge 68 that has been adapted for engaging the resilient tab 64 or a barb 70 positioned along the resilient tab 64. It is also contemplated that the recess may contain a barb or protrusion that will allow the tab to advance in one direction through the aperture 66. In the embodiment illustrated in FIGS. 2 and 4A-4C, the pivoting the sections 36 relative to one another about the hinge 60 allows the insertion of the resilient tab 64 into the aperture 66, so that the barb 70 engages the edge 68 to allow the retention nut 34 to engage the recesses or threads 32 in the external surface 26 of the valve stem 18.

Figure 5:
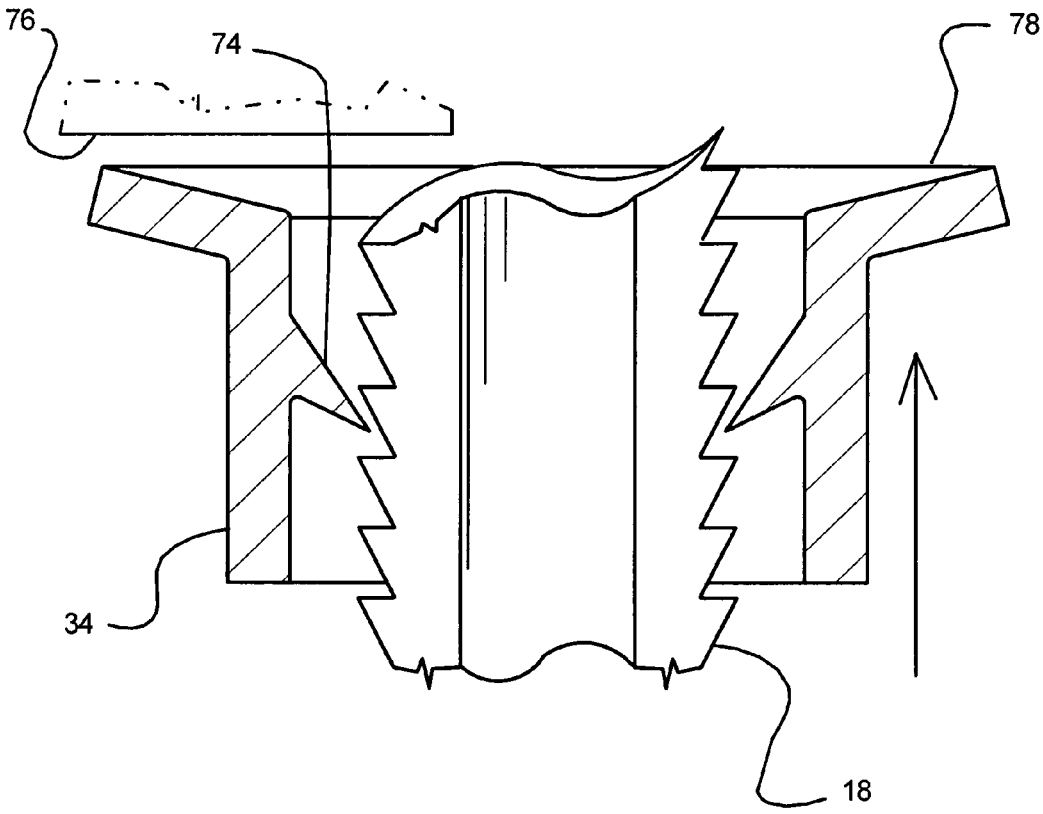
FIG. 5 illustrates another embodiment of the retention nuts that uses the principles taught here, the illustrated example including an engagement protrusion that is a resilient pawl that allows the user to simply push the retention nut up, towards the bottom of the sink or counter top.

Turning to FIG. 5, it will be understood that the principles disclosed herein may be used to create a variation of the pair of sections 36, for the retention nut 34. In this example the inner surface 38 of one of the sections 36 includes an advancement barb 74, which is designed to engage the external surface 26 of the stem 18 when the retention nut 34 has been assembled around the stem 18. Thus, with this example, the assembled retention nut 34 can be simply slid up towards the lower surface 76 of the sink or countertop 14, regardless of whether there are helical threads on the outer surface of the stem 18, with the advancement barb 74 engaging the surface of the stem 18 and allowing advancement in one direction along the stem. Additionally, a resilient edge 78 may be incorporated into the retention nut 34. The resilient edge 78 assisting in maintaining pressure between the retention nut 36 and the lower surface 76 of the sink or countertop 14. Thus, with the example illustrated in FIGS. 2 and 4A-C, the retention nut would be removed by releasing moving the resilient tab 64 so as to release the barb 70 from the edge 68.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A faucet installation system for installing a faucet on a sink or countertop having at least one mounting aperture adapted for mounting the faucet from the sink or countertop, the sink or countertop having a lower surface, the faucet including a valve stem that is adapted for insertion through one of the apertures, the system including:

a valve having a valve stem, the valve stem being adapted for insertion through the aperture, the valve stem having an external surface having a perimeter, the perimeter including engagement recesses; and a retention nut, the retention nut comprising a pair of sections, each section having a concave inner surface and an outer surface, the inner surface of at least one section having an engagement protrusion that has been adapted for engaging the engagement recesses in the external surface of the valve stem, each of the sections of the retention nut further having a pair of ends, one of the ends of each of the sections having a resilient connector comprising a semi-cylindrical female portion for engaging a generally cylindrical male portion on an end on the other section, so that the pair of sections are hingedly connected to one another when the female cylindrical portion engages the generally cylindrical male portion and thus forming a closed nut around the valve stem to allow the engagement protrusion to engage the engagement recesses in the external surface of the valve stem, the retention nut further comprising a second set of resilient connectors, the second set of resilient connectors comprising a resilient tab on one of the sections, the resilient tab having a barb along the tab, and the other section includes an aperture having an edge adapted for engaging the barb on the resilient tab such that a portion of the resilient tab extends from the aperture when the barb engages the resilient tab, so that pivoting the sections relative to one another through the first set of resilient connectors allows the insertion of the resilient tab into the aperture and the barb engages the edge adapted for accepting the resilient tab, and so that the sections form a closed nut that engages the recesses in the external surface of the valve stem so that the retention nut may be retained at a fixed location along the valve stem, and the closed nut may be released by moving the resilient tab to disengage the barb from the edge of the aperture.

2. A faucet installation system according to claim 1 wherein said engagement protrusion comprises a section of helical threads.

3. A faucet installation system according to claim 2 wherein said engagement protrusion comprises at least one advancement barb protrudes in a non-helical manner from one of the sections, the advancement barb being adapted for engaging the engagement recesses in the external surface of the valve stem, so that the retention nut may be advanced in one direction along the stem without turning the nut about the stem.

4. A faucet installation system for installing a faucet on a sink or countertop, the sink or countertop having a pair of mounting apertures adapted for mounting the faucet, the sink or countertop having a lower surface, the faucet including a valve stem that is of integral construction with a water supply line, and adapted for insertion through one of the apertures, the system including:

a pair of valves connected to one another through a mounting plate, each valve having a generally cylindrical valve stem that extends away from the mounting plate, each of the valve stems being adapted for insertion through the aperture, each of the valve stem having an external surface having a perimeter, the perimeter including engagement recesses; and a pair of retention nuts, each retention nut comprising a pair of sections each of the sections being adapted for extending around about 180 degrees of the perimeter of the valve stem, each section having a concave inner surface and an outer surface, the concave inner surface of at least one section having an engagement protrusion that has been adapted for engaging the engagement recesses in the external surface of either of the valve stems, each of the sections of the retention nut further having a pair of ends, each of the ends of each of the sections having a resilient connector for engaging an end on the other section, the resilient connectors including a female cylindrical portion mounted on one of the sections, and a male cylindrical portion formed on another of the sections of the connector, the male portion being adapted for cooperating with the female cylindrical portion, so that female cylindrical portion accepts the male portion to create a hinge between the sections being joined, so that the sections may be connected to one another and thus forming a closed nut around the valve stem to allow the engagement protrusion to engage the engagement recesses in the external surface of the valve stem, the retention nut further comprising a second set of resilient connectors, the second set of resilient connectors comprising a resilient tab on one of the sections, the resilient tab having a barb along the tab, and the other section includes an aperture having an edge adapted for engaging the barb on the resilient tab such that a portion of the resilient tab extends from the aperture when the barb engages the resilient tab, so that pivoting the sections relative to one another through the first set of resilient connectors allows the insertion of the resilient tab into the aperture and the barb engages the edge adapted for accepting the resilient tab, and so that the sections form a closed nut that engages the recesses in the external surface of the valve stem so that the retention nut may be retained at a fixed location along the valve stem, and the closed nut may be released by moving the resilient tab to disengage the barb from the edge of the aperture.

5. A faucet installation system according to claim 4 wherein said engagement protrusion comprises a section of helical threads.

6. A faucet installation system according to claim 4 wherein said engagement protrusion comprises at least one advancement barb protrudes in a non-helical manner from one of the sections, the advancement barb being adapted for engaging the engagement recesses in the in the external surface of the valve stem, so that the retention nut may be advanced in one direction along the stem without turning the nut about the stem.

* * * * *